US007328535B1

(12) United States Patent
Correia

(10) Patent No.: US 7,328,535 B1
(45) Date of Patent: Feb. 12, 2008

(54) PIVOTABLE INTERLOCK BLOCK CONNECTOR

(75) Inventor: Horacio Correia, Terrebonne (CA)

(73) Assignee: Rinox Inc., Quebec (CA)

( * ) Notice: Subject to any disclaimer, the term of this patent is extended or adjusted under 35 U.S.C. 154(b) by 603 days.

(21) Appl. No.: 10/332,202

(22) PCT Filed: Jul. 4, 2000

(86) PCT No.: PCT/CA00/00796

§ 371 (c)(1),
(2), (4) Date: Aug. 12, 2003

(87) PCT Pub. No.: WO02/02876

PCT Pub. Date: Jan. 10, 2002

(51) Int. Cl.

| | |
|---|---|
| ***E04B 1/38*** | (2006.01) |
| ***E04B 1/00*** | (2006.01) |
| ***E04B 5/00*** | (2006.01) |
| ***E04B 7/00*** | (2006.01) |
| ***E04B 1/02*** | (2006.01) |
| ***E04B 2/00*** | (2006.01) |
| ***E04C 3/30*** | (2006.01) |
| ***E02D 3/02*** | (2006.01) |
| ***E02D 5/00*** | (2006.01) |
| ***E02D 17/00*** | (2006.01) |
| ***E02D 19/00*** | (2006.01) |

(52) U.S. Cl. ..... 52/285.1; 52/271; 52/565; 52/564; 52/585.1; 52/581.2; 52/582.2; 405/284; 405/286

(58) Field of Classification Search ..... 52/36.1, 52/239, 481.2, 285.1, 271, 564, 565, 582.1–585.1; 403/165, 263, 361; 446/85, 102, 111; 405/284, 405/286

See application file for complete search history.

(56) References Cited

U.S. PATENT DOCUMENTS

| | | | |
|---|---|---|---|
| 4,490,075 | A | 12/1984 | Risi et al. |
| 4,815,897 | A | 3/1989 | Risi et al. |
| 5,248,226 | A | 9/1993 | Risi et al. |

(Continued)

FOREIGN PATENT DOCUMENTS

| | | |
|---|---|---|
| CA | 2115462 | 8/1995 |

(Continued)

*Primary Examiner*—Richard E. Chilcot, Jr.
*Assistant Examiner*—Hunter M Dreidame
(74) *Attorney, Agent, or Firm*—Ziolkowski Patent Solutions Group, SC

(57) ABSTRACT

An interlock connector (10) for interlocking stackable building blocks (26). The blocks are provided with apertures (32), such as grooves, on their top and bottom surfaces. The connector comprises a main body which includes two separate and vertically superimposed body portions and is interposed between two stacked blocks with each body portion disposed in a respective groove (32). One body portion is pivotable with respect to another, with a vertical pivot axis that is offset from the central vertical axis of the main body, so as to be pivotable to positions where the stacked blocks are offset. In another embodiment, the interlock connector comprises a single piece main body having an aperture to receive a projection protruding from the surface of one of the stacked blocks while being disposed in the groove of the other block, with the connector being pivotable about the projection to positions where the stacked blocks are offset. Other embodiments include connectors with offset upper and lower body portions to interlock blocks having symmetrical grooves, wherein certain of the embodiments allow a block to be pivoted about a body portion.

6 Claims, 7 Drawing Sheets

U.S. PATENT DOCUMENTS 5,252,017 A * 10/1993 Hodel ..... 411/446
5,257,880 A * 11/1993 Janopaul, Jr. ..... 405/284
5,282,700 A * 2/1994 Rodrique ..... 405/284
5,518,434 A * 5/1996 Ziegler ..... 446/121
5,611,187 A * 3/1997 Jones ..... 52/646
5,827,106 A * 10/1998 Crepeau et al. ..... 446/128
6,116,807 A * 9/2000 Dzurko et al. ..... 403/165
6,126,506 A * 10/2000 Rudy ..... 446/85
6,273,778 B1 * 8/2001 Kyster ..... 446/168
6,389,987 B1 * 5/2002 King ..... 108/25
6,554,675 B1 * 4/2003 Nyengaard ..... 446/85

FOREIGN PATENT DOCUMENTS

CA 2114677 12/1997

* cited by examiner

PIVOTABLE INTERLOCK BLOCK CONNECTOR

CROSS-REFERENCE TO RELATED APPLICATION

This application is a 35 U.S.C. §371 of PCT International Application Number PCT/CA00/00796, which was filed 4 Jul. 2000 (Apr. 4, 2000), and was published in English.

FIELD OF THE INVENTION

The present invention relates to interlock connectors for outdoor landscaping stackable building blocks. More specifically, the present invention is concerned with a pivotable interlock block connector.

BACKGROUND OF THE INVENTION

Outdoor landscaping wall systems such as retaining wall structures comprised of stacked and interlocked precast concrete building blocks are well known. It is common to vertically stack such blocks in horizontal courses, wherein an upper course is offset with respect to the next lower course, so as to provide a retaining wall having a desired inclination. Usually, such blocks are provided with grooves on their top and bottom faces. In this way, interlock connectors can be interposed between two stacked building blocks and fitted in the grooves.

U.S. Pat. Nos. 4,490,075 and 4,815,897, both issued to Risi et al. on Dec. 25, 1984 and Mar. 28, 1989 respectively, teach an interlock block for a retaining wall system. This block has an axially extending projection upstanding from the top surface and the bottom surface has an axially extending recess of a configuration that is complementary to the projection. The projection is inwardly or eccentrically positioned so that when an upper block is connected to a lower block it is offset, creating an inclined wall structure.

U.S. Pat. No. 5,282,700 issued to Rodrique on Feb. 1, 1994 teaches an interlock block connector comprising an elongated main body to be interposed between two blocks. The elongated main body has offset upper and lower portions so as to offset two stacked blocks.

Canadian Patent Numbers 2,115,462 and 2,114,677, both issued to Correia et al. on Aug. 12, 1995 and Dec. 30, 1997, respectively, disclose blocks for constructing retaining walls having opposed flat top and bottom surfaces with respective grooves formed therein. Connecting elements are disposed within the grooves and interposed between two stacked blocks. The grooves are asymmetrically positioned so as to create an offset between two interconnected blocks.

U.S. Pat. No. 5,248,226 issued to Risi et al. on Sep. 28, 1993 teaches a connector for stackable blocks having offset upper and lower portions; the blocks have asymmetrically positioned grooves on their top and bottom surfaces hence, when blocks are vertically stacked, one course of blocks is offset with respect to the next course. A variety of connectors are provided having different configurations, such as a cylindrical upper body portion so as to allow one block to be pivoted about the connector with respect to a lower block.

A drawback with the prior art is that the same interlock connector cannot be used with blocks having symmetrical grooves to create more than one offsetness. Another disadvantage with the prior art is that connectors that allow an upper block to be pivoted with respect to a lower block are not of a generally rectangular configuration and hence, provide less stability and resistance against transversal displacement.

OBJECTS OF THE INVENTION

The general object of the present invention is therefore to provide an improved interlock connector for interlocking stackable building blocks.

Another object of the present invention is to provide an improved interlock connector for interlocking stackable building blocks free of the above-noted disadvantages.

A further object of the present invention is to provide an improved interlock connector for interlocking stackable building blocks that is pivotable between two stacked blocks to positions where the stacked blocks are offset and wherein one block may be pivoted with respect to the other interconnected block.

Yet another object of the present invention is to provide an interlock connector for interlocking stackable building blocks wherein the same connector may be used to provide more than one degree of offsetness between two stacked blocks.

SUMMARY OF THE INVENTION

More specifically, in accordance with one aspect of the present invention, there is provided an interlock connector for interlocking stackable building blocks, the blocks comprising respective top and bottom surfaces provided with apertures for receiving the interlock connector, the connector comprising:

a main body to be interposed between two stacked blocks, the main body having a central vertical axis and comprising vertically superimposed first and second body portions, one of the first and second body portions is snugly fitted in the bottom surface aperture of the upper block while the other body portion is snugly fitted in the top surface aperture of the next lower block, the first and second body portions being pivotable about a vertical pivot axis that is offset from the central vertical axis of the main body to positions wherein the upper block is offset with respect to the lower block.

Preferably, top and bottom surface apertures comprise substantially symmetrical grooves for snugly fitting therein a first or second body portion.

Preferably, one of said first and second body portions comprises a projection eccentrically positioned with respect to the central vertical axis of the main body and the other of the first and second body portions comprises a complementary aperture for receiving the projection therein so as to be pivotable about the projection.

Preferably, the first and second body portions comprise a generally rectangular configuration of substantially the same dimension and the projection comprises a generally cylindrical configuration.

Preferably, the second body aperture and the projection comprise mutually engaging fastening members for releasably fastening the first and second body portions. More preferably, the mutually engaging fastening members comprise snap fasteners.

In accordance with another aspect of the present invention, there is provided an interlock connector for interlocking stackable building blocks, the blocks comprising respective top and bottom surfaces, wherein either the bottom surface of an upper block or the top surface of the next lower block comprises an aperture while the other comprises a projection, the connector comprising:

a main body to be interposed between two stacked blocks, this main body having a central vertical axis and comprising an aperture eccentrically positioned with respect to this central vertical axis, the main body aperture pivotally receiving the projection of one block therein, the main body being fitted in the aperture of the other block, the main body having a vertical pivot axis that is offset from the central vertical axis of the main body so as to be pivotable about the projection to positions wherein one stacked block is offset relative to the other stacked block.

Preferably, the block aperture comprises a groove for snugly fitting therein the main body.

Preferably, the main body comprises a generally rectangular configuration and the projection comprises a generally cylindrical configuration.

In accordance with yet another aspect of the present invention, there is provided an interlock connector for interlocking stackable building blocks, the blocks comprising respective top and bottom surfaces, the top and bottom surfaces comprising respective and substantially symmetrical apertures, the connector comprising:

a main body to be placed in the block apertures thus interposed between two stacked blocks, the main body comprising vertically superimposed first and second body portions, the first and second body portions being offset with respect to one another, one of the first and second body portions being snugly fitted within the bottom surface aperture of the upper block, the other body portion being snugly fitted within the top surface aperture of the next lower block so as to offset the two stacked blocks.

Preferably, the block apertures comprise grooves.

Preferably, the first and second body portions comprise a generally rectangular configuration of substantially the same dimension.

Alternatively, the first and second body portions comprise a generally cylindrical configuration of substantially the same dimension and the blocks are pivotable about the first and second body portions.

Alternatively, one of the first and second body portions comprises a generally rectangular configuration and the other body portion comprises a generally cylindrical configuration with the block being pivotable about this other body portion.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

Figure 1:
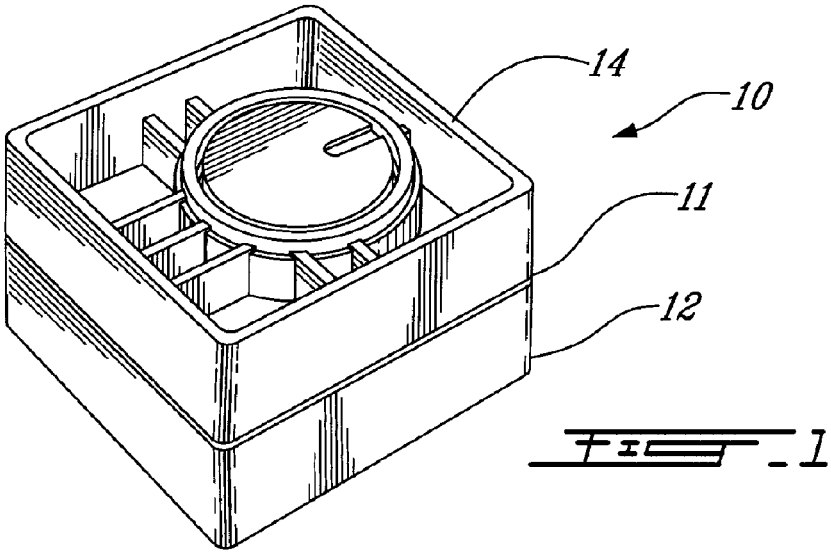
FIG. 1 is a perspective view of a preferred embodiment of the present invention.
Figure 2:
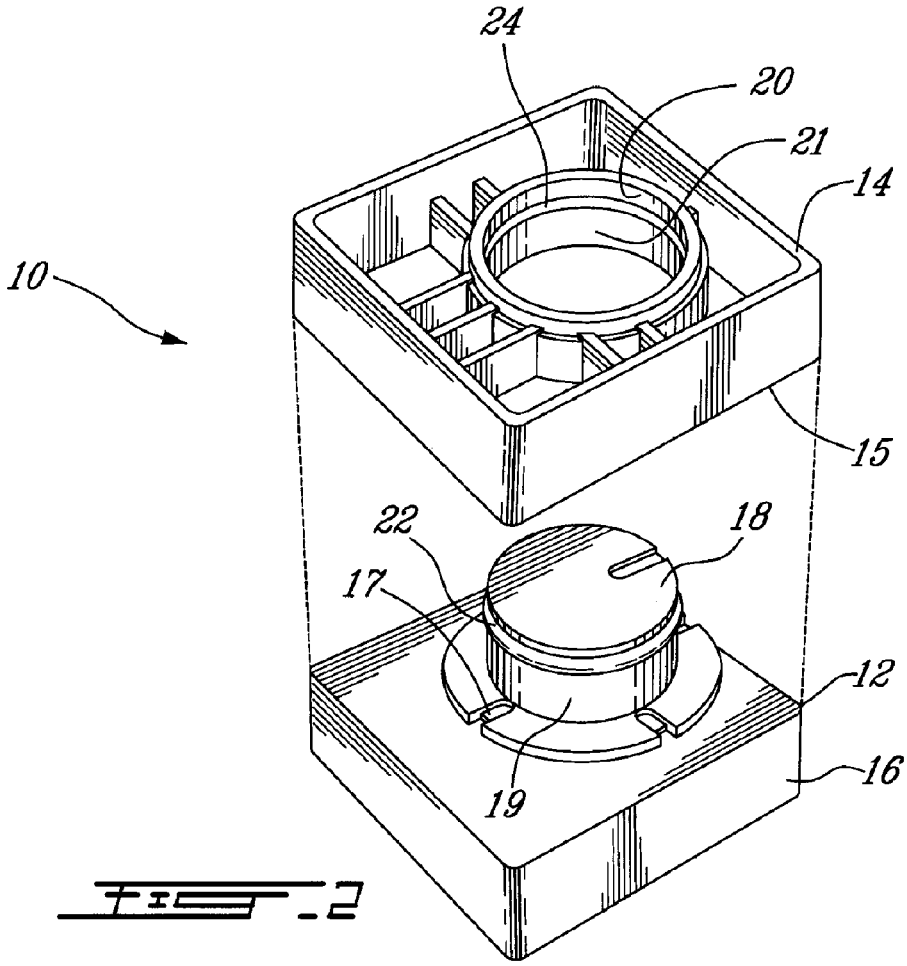
FIG. 2 is an exploded view of FIG. 1.

FIGS. 1 and 2 show a preferred embodiment of the interlock block connector 10 according to the present invention, shown here having a main body 11 formed of two separate and vertically superimposed lower and upper body portions, 12 and 14, respectively. The terms "upper" and "lower" are used throughout the disclosure only to simplify the present description when referring to the interlock block connector in accordance with the present invention. It will therefore become apparent, as will be discussed hereinbelow, that body portion 12 may also be superimposed on top of body portion 14.

The lower body portion 12 includes a base 16 and a projection 18 extending therefrom. Projection 18 is eccentrically positioned with respect to base 16. Preferably, base 16 has a generally rectangular configuration and projection 18 has a generally cylindrical configuration. The upper body portion 14 comprises a complementary aperture 20 for pivotally fitting projection 18 therein. Preferably, body portion 14 has a generally rectangular configuration substantially similar in size to base 16.

Projection 18 and aperture 20 may include mutually engaging fastening members on their outer wall 19 and inner wall 21, respectively. Fastening members such as ring ridges 22 and complementary ring recesses 24 may be used for releasably snap fitting projection 18 and aperture 20. Other types of fastening members known to the skilled artisan may also be used. It must also be noted that a variety of complementary apertures and projections may also be used for pivotally assembling the separate body portions 12 and 14. For example, one body portion may include a projecting pin member to be pivotally inserted in the complementary aperture of the other body portion.

When the main body 11 is assembled as in FIG 1, body portion 14 can be pivoted about projection 18. Obviously, body portion 12 can also be pivoted about aperture 20. Both projection 18 and aperture 20 are eccentrically positioned with respect to the main body 11. Therefore, the pivot axis of body portions 12 and 14 is offset from the central vertical axis of the main body 11. In this way, one body portion 12 or 14 may be pivoted to positions where the body portions 12 and 14 are offset with respect to one another as shown in FIGS. 4, 5, 6, 7 and 8.

Figure 3:
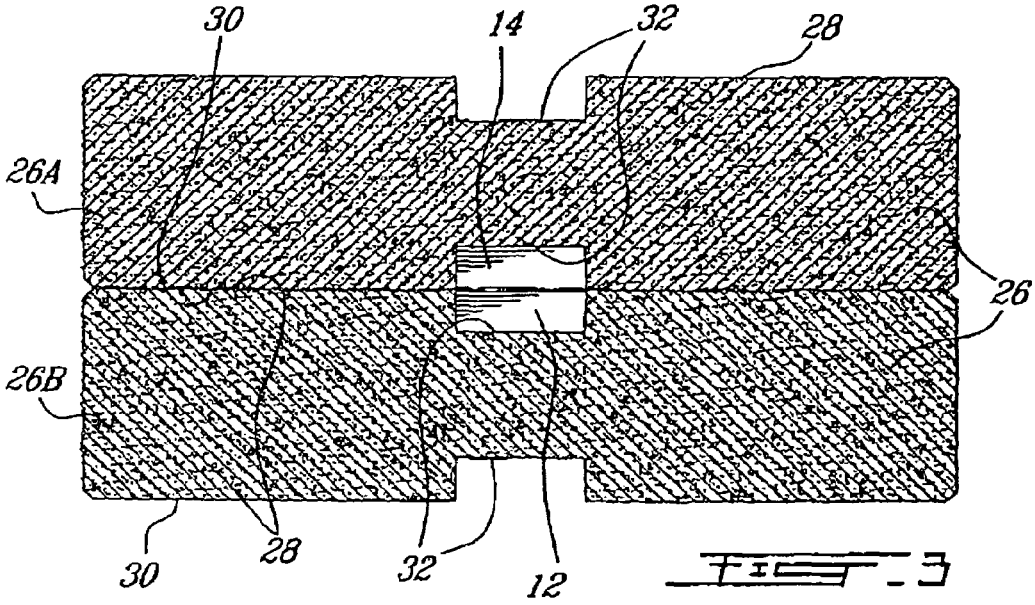
FIG. 3 is a front elevational view of the present invention interlocking two stacked blocks.
Figure 4:
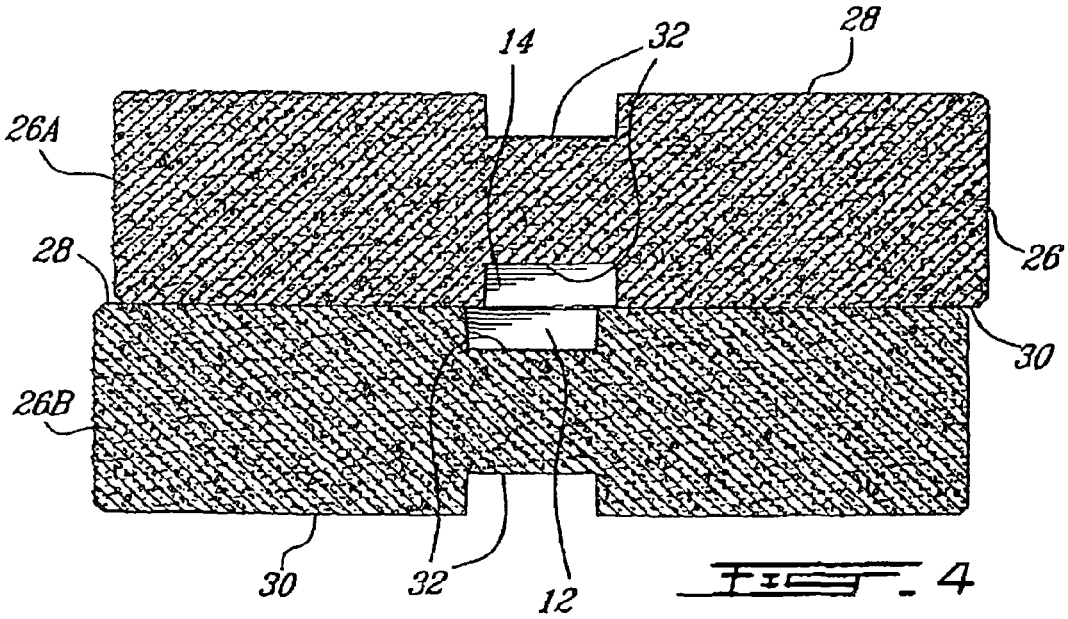
FIG. 4 is a front elevational view of the present invention interlocking two blocks in an offset position.
Figure 5:
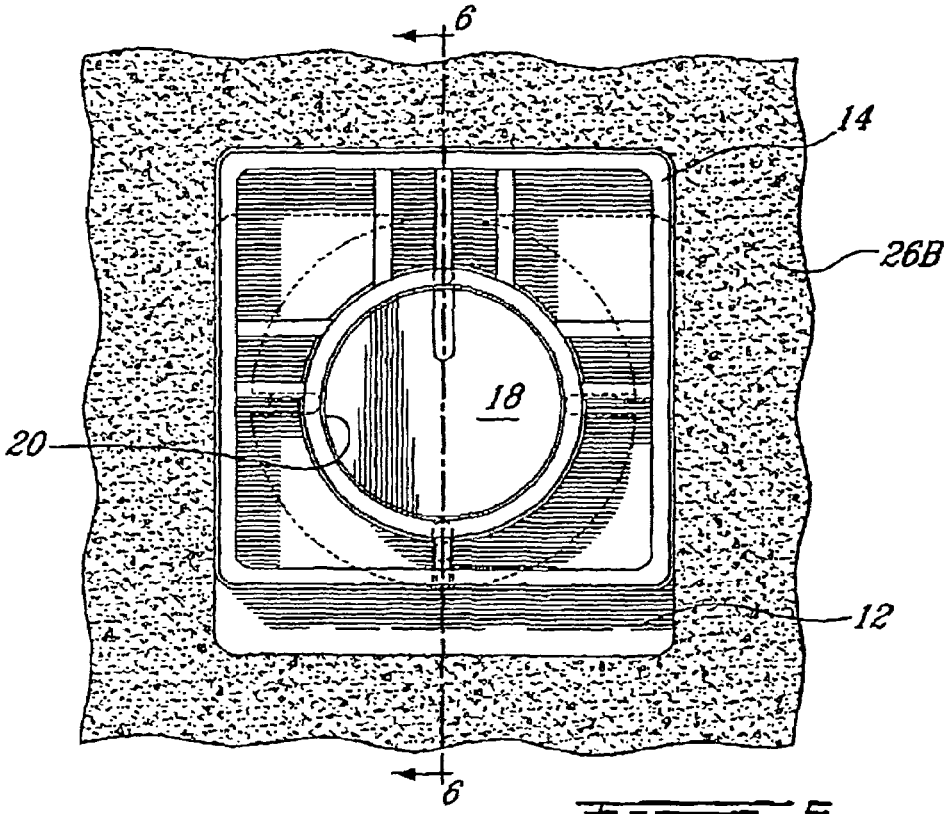
FIG. 5 is a top view of the interlock connector of FIG. 4.
Figure 6:
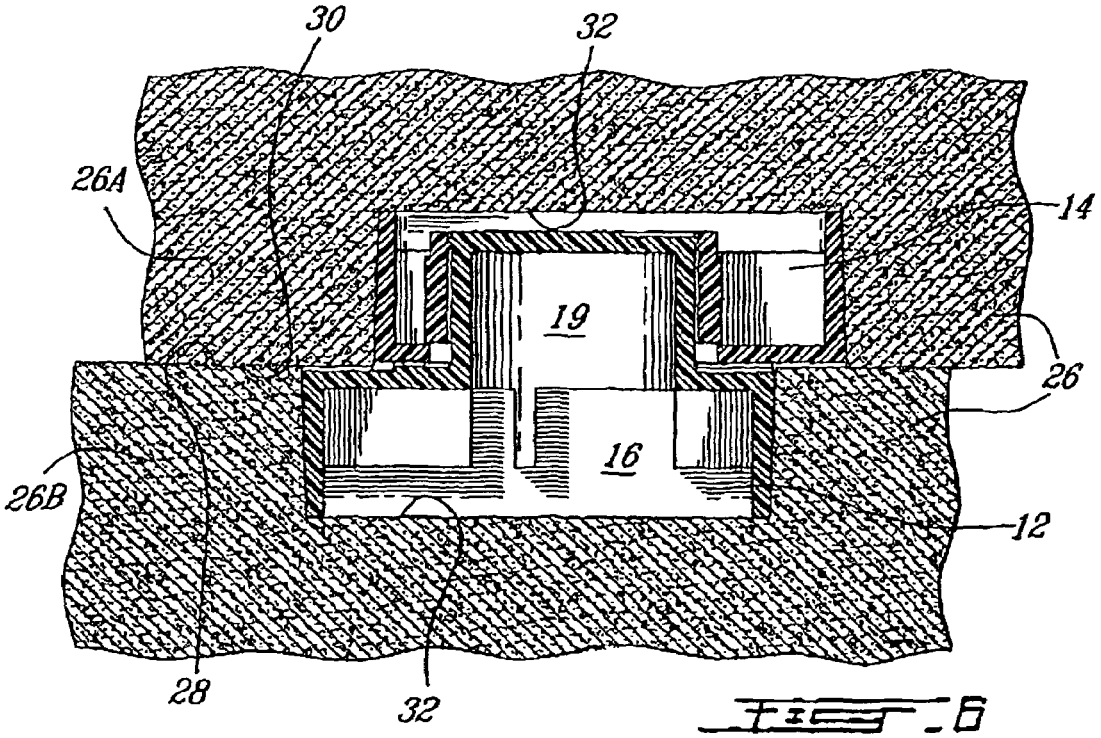
FIG. 6 is a sectional view of FIG. 5 along the line 6-6.

FIG. 3 shows the main body 11 of the present interlock connector interposed between two stacked blocks 26. Blocks 26 are preferably rectangular in configuration and bounded by generally parallel and similar top and bottom surfaces 28, 30 respectively (also see FIG. 4). Preferably, blocks 26 are precast concrete stackable building blocks used particularly in retaining wall systems. Hence, it is understood that the blocks used in the present invention are not limited to the configuration illustrated herein; all that is required is that blocks 26 be of a suitable configuration to enable like blocks to be vertically stacked in overlying wall defining relation.

The top and bottom surfaces 28 and 30 of blocks 26 are provided with respective apertures 32 for receiving therein the interlock connector 10. Advantageously, apertures 32 are provided in the form of grooves and preferably, in the form of substantially symmetrical grooves 32. In this way, the task of building a retaining wall is simplified since identical blocks may be used. Grooves 32 may be long rectangular slots as better seen in FIGS. 7 and 8. Of course block apertures 32 may be in the form of rectangular holes or any other suitable configuration capable of receiving the interlock connector 10.

When the main body 11 is interposed between two blocks 26 as in FIG. 3, for example, one of the body portions preferably the upper body portion 14, is snugly fitted in groove 32 of an upper block 26A while the other body portion, preferably lower body portion 12, is snugly fitted in groove 32 of the next lower block 26B. The rectangular configuration of body portions 12 and 14 allows the interlock connector of the present invention to interlock two stacked blocks 26 against lateral displacement. It is understood that other types of grooves and body portion configurations may also be used; it is preferable to use configurations that minimise the lateral displacement of the stacked blocks 26.

An upper block 26A can be pivoted along with an upper body portion 14, with respect to a lower block 26B, to positions where the body portions 12 and 14 are offset causing the upper and lower blocks 26A and 26B to be offset as well as shown in FIGS. 4, 6, 7 and 8. Obviously, body portions 12 and 14 can be adjusted to be offset before stacking an upper block 26A on a lower block 26B. This would especially be the case when blocks 26 are provided with grooves that are not symmetrical.

Figure 8:
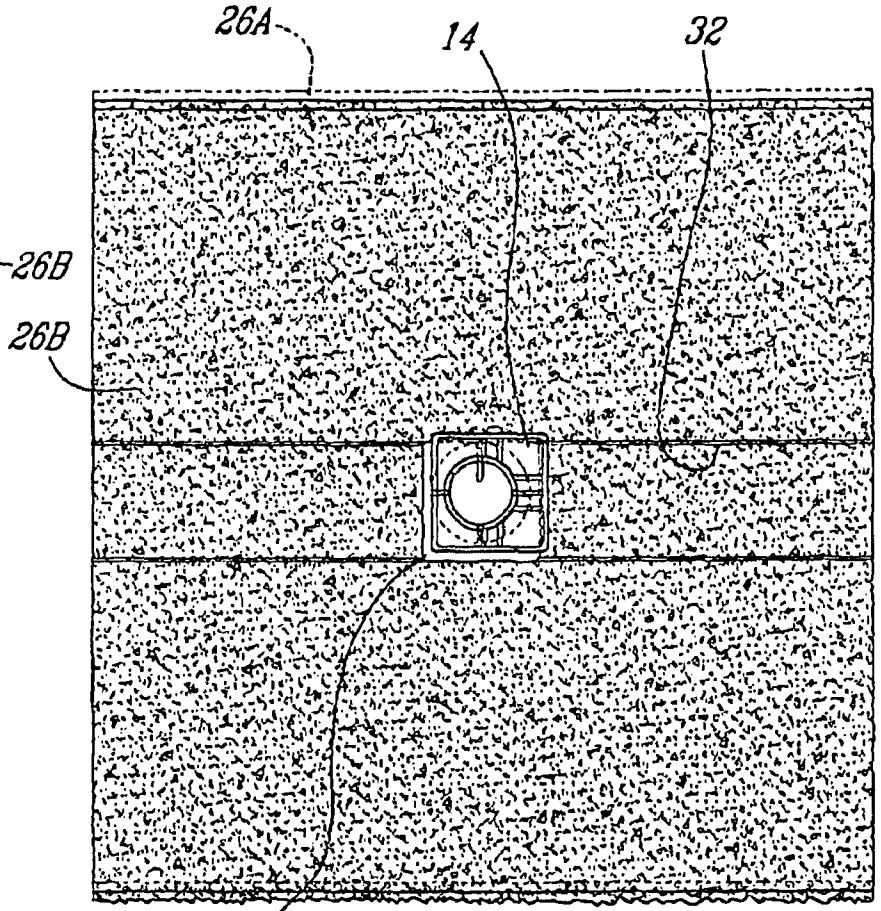
FIG. 8 is a top view of the present invention interlocking two stacked blocks in an offset position that is different than the offset position of FIG. 7, wherein the upper block is represented in dotted line.
Figure 7:
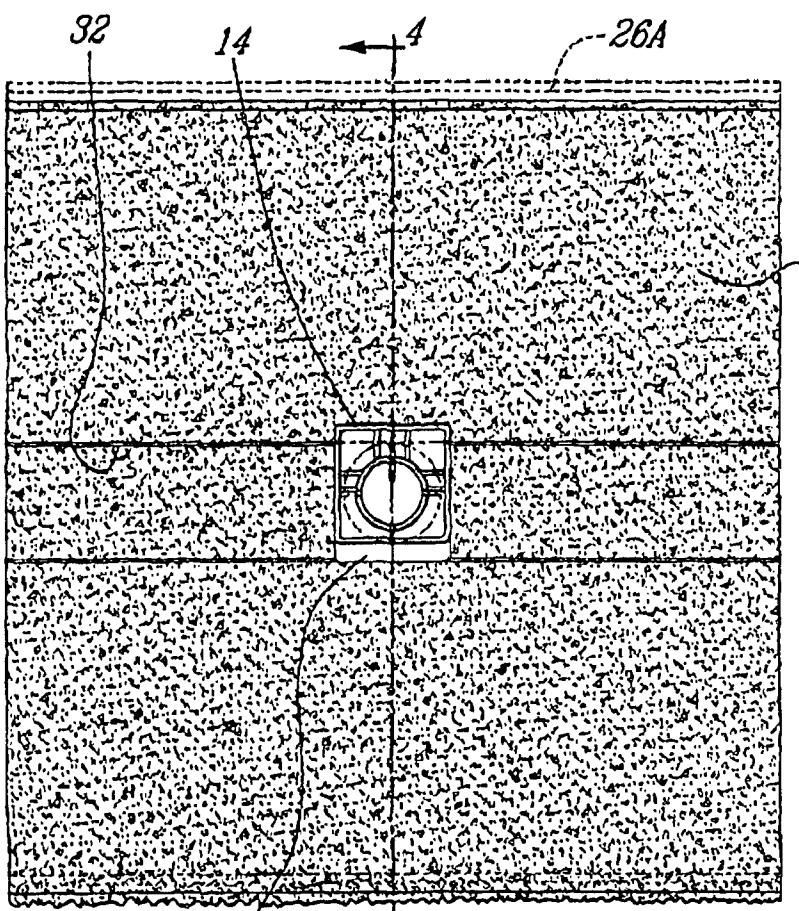
FIG. 7 is a top view of the present invention interlocking two stacked blocks in an offset position, wherein the upper block is represented in dotted line.

As is common in retaining wall structures, a plurality of blocks 26 may be vertically stacked in interlocked, overlapping horizontal courses. The offset of the body portions 12 and 14 will allow the horizontal courses of blocks to be offset with the next adjacent course in order to create an inclined wall structure. In the present example, a desired offsetness may be selected by pivoting upper body portion 14 to a "slightly" offset position as shown in FIG. 8 or to a "greater" offset position as shown in FIG. 7.

Referring again to FIG. 1, body portion 14 may have protrusions (not shown) on its underside 15 which can be fitted in complementary slots 17 in body portion 12. In this way, body portions 12 and 14 are stabilised at a given position, such as the positions shown in FIGS. 3, 7 and 8.

The pivotability of body portions 12 and 14 allows for interlocked, horizontally overlapping blocks 26 to be pivoted with respect to one another in order to build a horizontally curved wall structure. Complementary vertical ridges (not illustrated) may also be provided along the outer wall 19 of projection 18 and the inner wall 21 of aperture 20, in order to produce a "clicking" sound when a body portion 12 or 14 is pivoted; this may allow the builder to estimate to what degree one block has been pivoted with respect to another, facilitating the building of a horizontally curved wall structure. Wall corners may also be created by pivoting an upper block 26A to a position where its longitudinal axis is perpendicular to the longitudinal axis of a lower block 26B.

Figure 9:
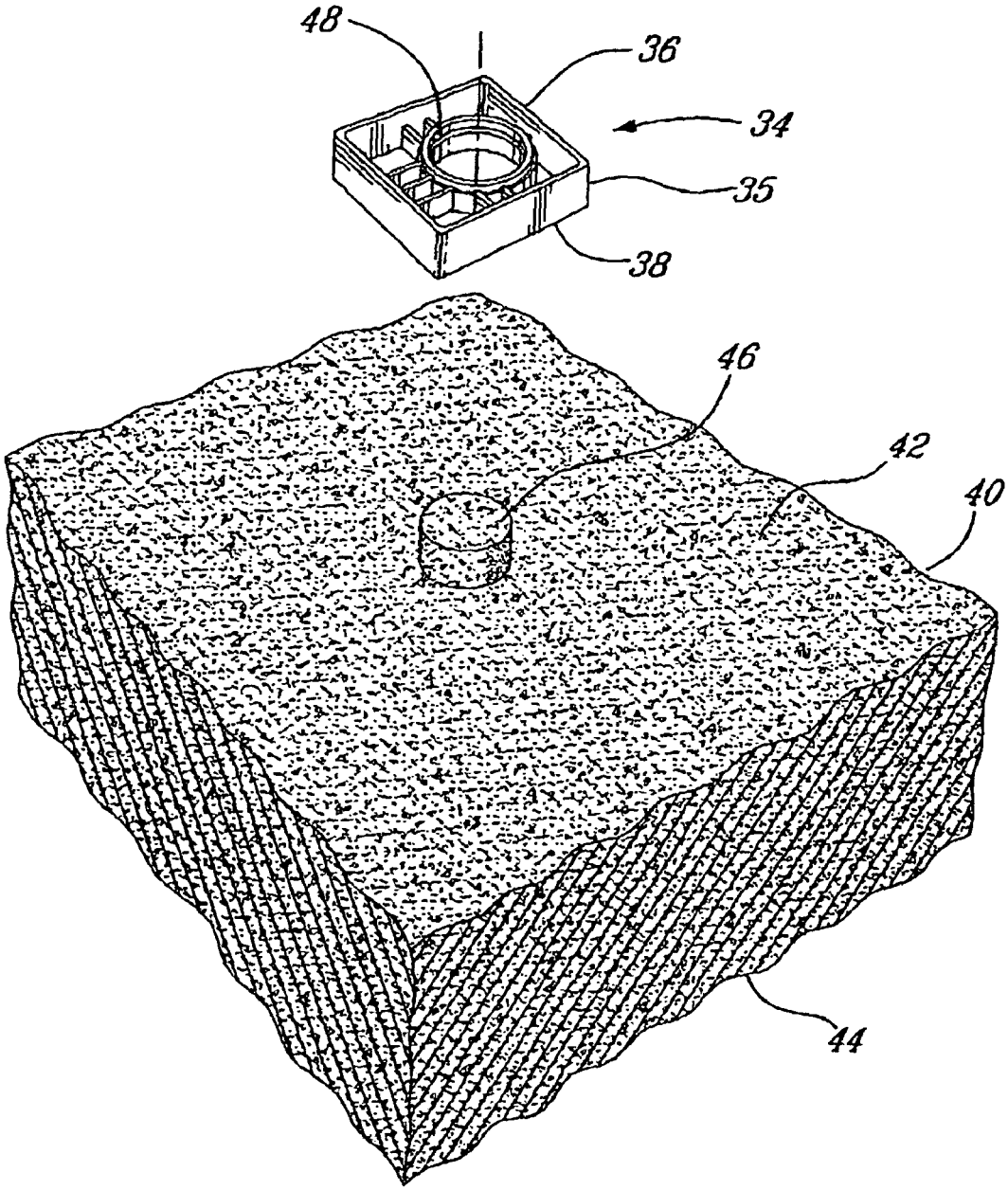
FIG. 9 is a perspective view of another preferred embodiment of the present invention.

In another embodiment in accordance with another aspect of the present invention, an interlock connector 34 as illustrated in FIG. 9, may comprise a main body 35 which is a single piece. Main body 35 includes similar "upper" and "lower" body portions 36, 38, respectively.

Also shown in FIG. 9 is block 40, which like block 26, is a precast concrete stackable building block. Block 40 is vertically bounded by opposite surfaces 42 and 44. At least one surface, in this example surface 42, is a connector-engaging surface and hence, includes a projection 46. Surface 44 may be provided with an aperture such as a groove to receive therein connector 34. The main body 35 has a complementary and eccentrically positioned aperture 48 to pivotally receive projection 46. Projection 46 is preferably in the form of a concrete peg made of the same concrete material as building block 38 and is advantageously cylindrical in configuration. In the example illustrated in FIG. 9 aperture 48 is built through the whole main body 35. It is within the scope of the invention though, that the upper body portion 36 may comprise a closed top surface while the lower body portion 38 includes aperture 48.

Block 40 may be either stacked on top of a lower block 26B or an upper block 26A may be stacked on top of block 38 with projection 46 facing either block 26A or 26B, as the case may be. The main body 35 is interposed between blocks 26 and 38 with body portion 36 snugly fitted in a groove 32 of a block 26 while body portion 38 receives projection 46. The main body 35 is pivotable about projection 46. Since aperture 48 is eccentrically positioned, the pivot axis of main body 35 will be offset from the central vertical axis of the main body 35. Main body 35 functions much like body portion 14 in FIG. 2; hence, it is pivotable about projection 46, like body portion 14 is pivotable about projection 18, to positions where the stacked blocks 38 and 26 are offset.

Figure 11:
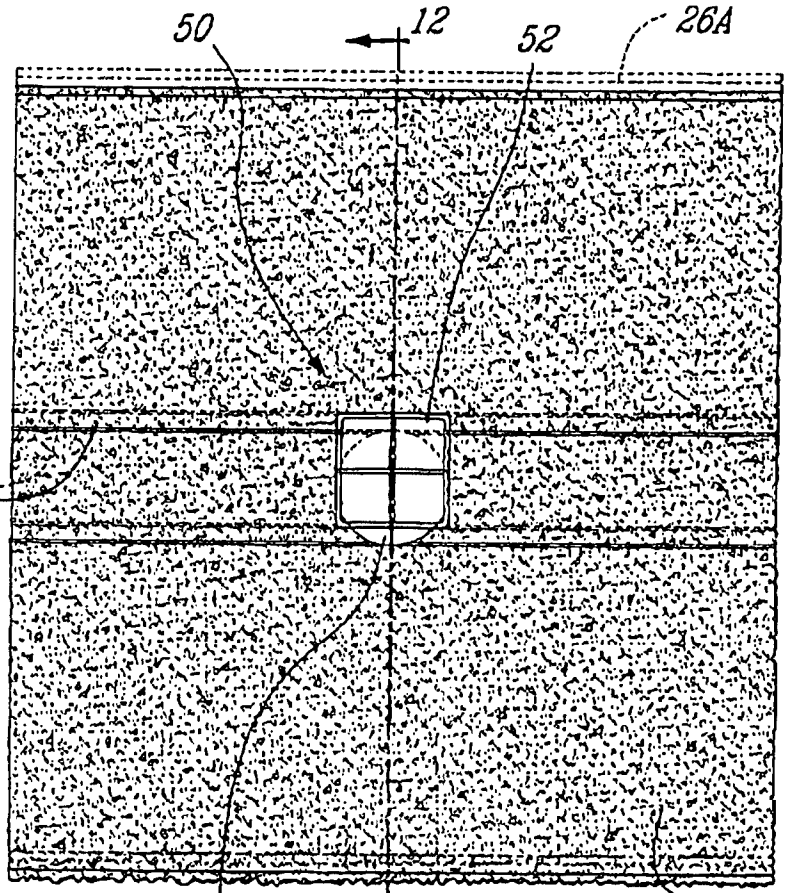
FIG. 11 is a view similar to FIG. 10.
Figure 10:
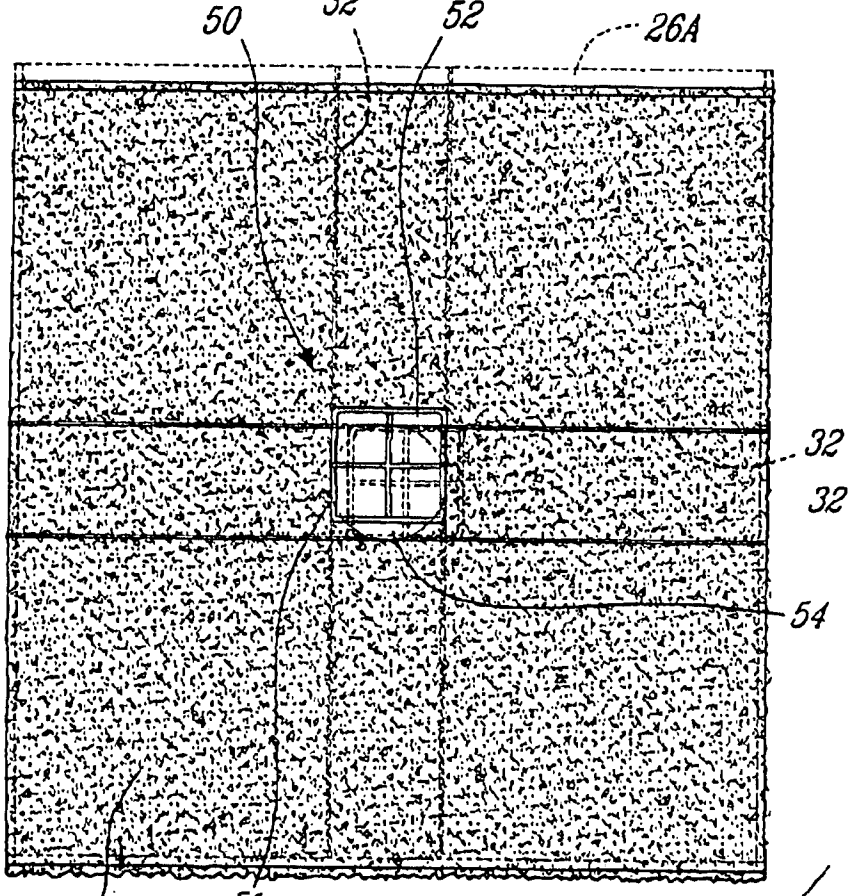
FIG. 10 is a top view of yet another preferred embodiment of the present invention interlocking two stacked blocks wherein the upper block is represented in dotted line.
Figure 12:
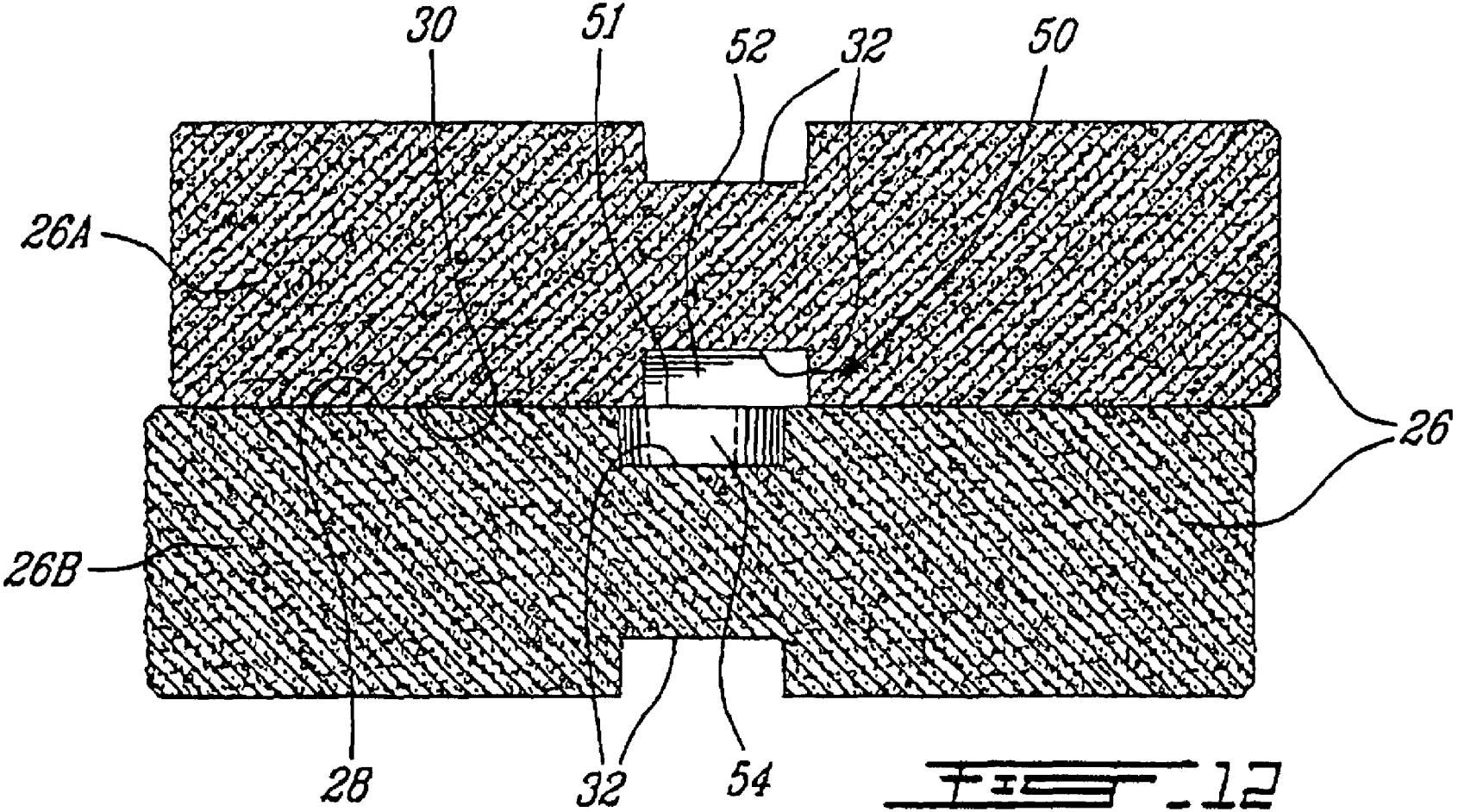
FIG. 12 is a sectional view along the line 12-12 of FIG. 11.

FIGS. 10, 11 and 12 illustrate another preferred embodiment of an interlock block connector 50, in accordance with yet another aspect of the present invention, having a main body 51 formed of a single piece and which comprises offset "upper" and "lower" body portions 52 and 54, respectively. Body portion 52 has a generally rectangular configuration and body portion 54 has a generally cylindrical configuration. When two blocks 26 are stacked and interlocked by way the main body 51 being interposed therebetween, body portion 52 will be snugly fitted into the groove 32 of the upper block 26A and body portion 54 will be snugly fitted in the groove 32 of the lower block 26B.

The circular configuration of body portion 52 allows for an upper block 26A to be pivoted, as in FIG. 10, with respect to a lower block 26B as the lower body portion turns within the groove 32 of the lower block 26B.

In another embodiment (not illustrated), both body portions of main body 51 may have cylindrical configurations similar to that of body portion 54. In yet another preferred embodiment (not illustrated), both body portions of main body 51 may have a generally rectangular configuration similar to that of body portion 52; this will allow for both body portions to be snugly fit within grooves 40, yet pivoting would not be possible with such a configuration.

Advantageously the various embodiments described herein of the present interlock block connector are made from a strong and durable plastic material.

Although the present invention has been described hereinabove by way of preferred embodiments thereof, it can be modified, without departing from the spirit and nature of the subject invention as defined in the appended claims.

What is claimed is:

1. An assembly of interlocking tiers of stackable precast concrete building blocks, said blocks being of the type used to erect walls by stacking said blocks in vertical or setback configurations, said blocks being of the type having planar top and bottom surfaces having symmetrical apertures on their top and bottom surfaces, said blocks being connected by a connecter, said connector being shaped and sized to snugly fit in the apertures of said blocks so as to prevent sliding of blocks once interlocked by the connector, said connector having a first body portion defining a shape contour and being adapted for assembly in manually pivotable relationship with a second body portion having a shape contour similar to the first body portion, said pivotable relationship being established at a point offset from the geometrical center of the body portions whereby when assembled, the connector can be manually adjusted to provide a shape contour typical of a vertical interlocking mode and at least one offset shape contour typical of an offset interlocking mode; wherein the pivotable relationship is established by providing a generally cylindrical protrusion on the first body portion and providing on the second body portion a corresponding aperture, sized and shaped to receive said protrusion.

2. The assembly of claim 1 wherein said second body portion is pivotable about said protrusion.

3. The assembly of claim 2 wherein the first and second body portions have a generally rectangular box shape contour.

4. The assembly of claim 3 wherein the first body portions are releasably and manually adjustable in preset pivoting relationships by providing mutually engageable protuberances and cooperating depressions on the respective body portions whereby the body portions can be pivoted in and out of preset relative positions.

5. The assembly of claim 2 wherein the first and second body portions are snap-fitted together for assembly.

6. A kit of parts including a block and corresponding connector, the parts kit for assembly a respective connector with tiers of stackable precast concrete building blocks, said blocks being of the type used to erect walls by stacking said blocks in vertical or setback configurations, said blocks being of the type having planar top and bottom surfaces having symmetrical apertures on their top and bottom surfaces, said connector being shaped and sized to snugly fit in the apertures of said blocks so as to prevent sliding of blocks once interlocked by the connector, said connector having a first body portion defining a shape contour and adapted for assembly in manually pivotable relationship with second body portion having a shape contour similar to the first body portion, said pivotable relationship being established at a point offset from the geometrical center of the body portions whereby when assembled, the connector can be manually adjusted to provide a shape contour typical of a vertical interlocking mode and at least one offset shape contour typical of an offset interlocking mode; wherein the pivotable relationship is established by providing a generally cylindrical protrusion on the first body portion and providing on the second body portion a corresponding aperture, sized and shaped to receive said protrusion.

* * * * *

UNITED STATES PATENT AND TRADEMARK OFFICE

CERTIFICATE OF CORRECTION

PATENT NO. : 7,328,535 B1
APPLICATION NO. : 10/332202
DATED : February 12, 2008
INVENTOR(S) : Horacio Correia It is certified that error appears in the above-identified patent and that said Letters Patent is hereby corrected as shown below:

Col. 8, line 2 (Claim 6), delete “assembly” and substitute therefore -- assembling --.

Signed and Sealed this

Twenty-seventh Day of May, 2008

JON W. DUDAS
*Director of the United States Patent and Trademark Office*